US011557869B2

(12) United States Patent
Ding

(10) Patent No.: US 11,557,869 B2
(45) Date of Patent: Jan. 17, 2023

(54) COMBINED POWER SOCKET FOR ARTIFICIAL TREE

(71) Applicant: Yunmeng Yun Xi Lighting Products Co., Ltd., Xiaogan (CN)

(72) Inventor: Feng Ding, Xiaogan (CN)

(73) Assignee: YUNMENG YUN XI LIGHTING PRODUCTS CO., LTD., Xiaogan (CN)

( * ) Notice: Subject to any disclaimer, the term of this patent is extended or adjusted under 35 U.S.C. 154(b) by 355 days.

(21) Appl. No.: 17/013,813

(22) Filed: Sep. 7, 2020

(65) Prior Publication Data

US 2022/0052497 A1 Feb. 17, 2022

(30) Foreign Application Priority Data

Aug. 12, 2020 (CN) ..... 202021667403.9

(51) Int. Cl.

| | |
|---|---|
| ***H01R 31/00*** | (2006.01) |
| ***H01R 13/22*** | (2006.01) |
| ***H01R 13/502*** | (2006.01) |
| ***F21V 23/06*** | (2006.01) |
| ***F21V 33/00*** | (2006.01) |
| ***A47G 33/06*** | (2006.01) |
| ***H01R 9/24*** | (2006.01) |
| *F21W 121/04* | (2006.01) |
| *H01R 13/04* | (2006.01) |
| *H01R 13/10* | (2006.01) |
| *H01R 13/629* | (2006.01) |

(52) U.S. Cl.

CPC ..... *H01R 31/00* (2013.01); *A47G 33/06* (2013.01); *F21V 23/06* (2013.01); *F21V 33/0028* (2013.01); *H01R 9/24* (2013.01); *H01R 13/22* (2013.01); *H01R 13/502* (2013.01); *F21W 2121/04* (2013.01); *H01R 13/04* (2013.01); *H01R 13/10* (2013.01); *H01R 13/629* (2013.01)

(58) Field of Classification Search

CPC ..... H01R 31/00; H01R 9/24; H01R 13/22; H01R 13/502; H01R 13/04; H01R 13/10; H01R 13/629; H01R 33/94; A47G 33/06; F21V 23/06; F21V 33/0028; F21W 2121/04

See application file for complete search history.

(56) References Cited

U.S. PATENT DOCUMENTS

| | | | | |
|---|---|---|---|---|
| 4,675,575 | A * | 6/1987 | Smith | F21S 4/10 313/499 |
| 9,204,502 | B1 * | 12/2015 | Ding | H05B 45/30 |
| 10,305,238 | B2 * | 5/2019 | Ding | H01R 24/86 |
| 2018/0269641 | A1 * | 9/2018 | Ding | H01R 13/04 |
| 2022/0052497 | A1 * | 2/2022 | Ding | A47G 33/06 |
| 2022/0183492 | A1 * | 6/2022 | Szweda | A47G 33/06 |

* cited by examiner

*Primary Examiner* — Abdullah A Riyami
*Assistant Examiner* — Nader J Alhawamdeh
(74) *Attorney, Agent, or Firm* — Hemisphere Law, PLLC; Zhigang Ma

(57) ABSTRACT

The present invention provides a combined power socket for artificial trees. The combined power socket includes a first socket and a second socket which are capable of supplying control signals to light strings on the artificial trees in addition to power supply, thus can realize the intelligent control of light strings. Furthermore, the first socket and a second socket can be connected in two directions without considering the positive and negative poles of the power supply. The product assembly is simpler and more convenient.

7 Claims, 3 Drawing Sheets

COMBINED POWER SOCKET FOR ARTIFICIAL TREE

BACKGROUND OF THE INVENTION

1. Field of the Invention

The present invention relates to electrical connectors, and particularly to a combined power socket for an artificial tree and an artificial tree having the combined power socket.

2. Description of Related Art

The string is widely used for indoor and outdoor decorating Christmas trees, decorations are essential festivals. A large number of general configuration to decorate the Christmas lights string 5-10 or above. At present, setting multiple string plug and jack adapter for power supply socket string, Jack number is generally two to ten, so can only be connected with two to ten strings. If you need to connect more string will be equipped with one or more additional power socket, which need to use one or more electrical socket. Generally, one side of the wall on the general configuration of a city outlet, it is easy to appear mains outlet is not enough, or the need to configure additional plug plate, the use of inconvenience. And in the process of assembly, the need for workers to climb down the wire, assembly is not safe.

Therefore, the connecting terminal is fixed on the Christmas tree trunk in the combined power, when the trunk of the upper and lower segments connected, fixed on the trunk in the combined electric connection terminals are electrically connected with each other, such as the application date is Dec. 24, 2015, the electric connector China utility model patent No. 20152107394.7 patent publication. However, the wires of the electric connector are extended and connected in the trunk, the assembly cost is high, and the electric connection cannot be observed in the use, and the utility model has great safety hidden trouble.

The utility model relates to a combined power socket which is disclosed in the patent application date of May 24, 2013 and the patent number 201320289695 of the utility model can be sheathed on the periphery of the trunk. However, the socket of the combined power supply socket is arranged on one of the socket body, and the manufacturing process is complex and needs to be improved. In addition, lamps in the existing light string each has a built-in chip, which can realize intelligent control, however the existing power socket for the artificial tree does not have an intelligent control line for transmitting control signals.

BRIEF DESCRIPTION OF THE SEVERAL VIEWS OF THE DRAWING(S)

The foregoing and other exemplary purposes, aspects and advantages of the present invention will be better understood in principle from the following detailed description of one or more exemplary embodiments of the invention with reference to the drawings, in which.

DETAILED DESCRIPTION OF THE INVENTION

The invention will now be described in detail through several embodiments with reference to the accompanying drawings.

Figure 1:
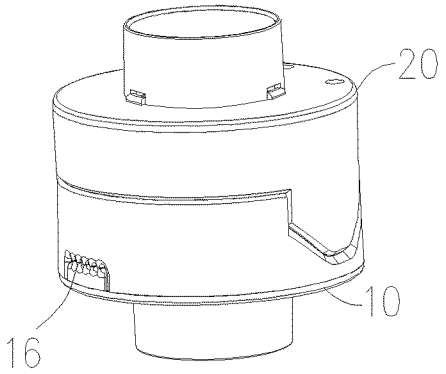
FIG. 1 is a perspective view of a combined power supply including a first socket and a second socket which are connected together in accordance with one embodiment of the present invention.
Figure 2:
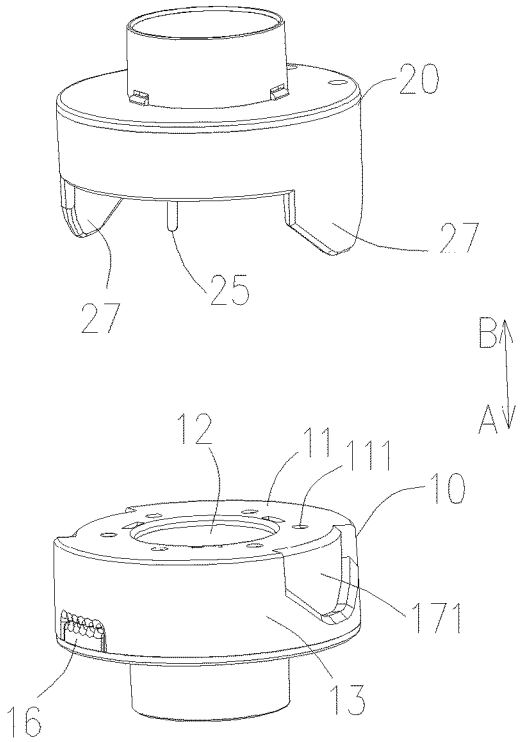
FIG. 2 is an exploded view of the combined power supply in FIG. 1.
Figure 3:
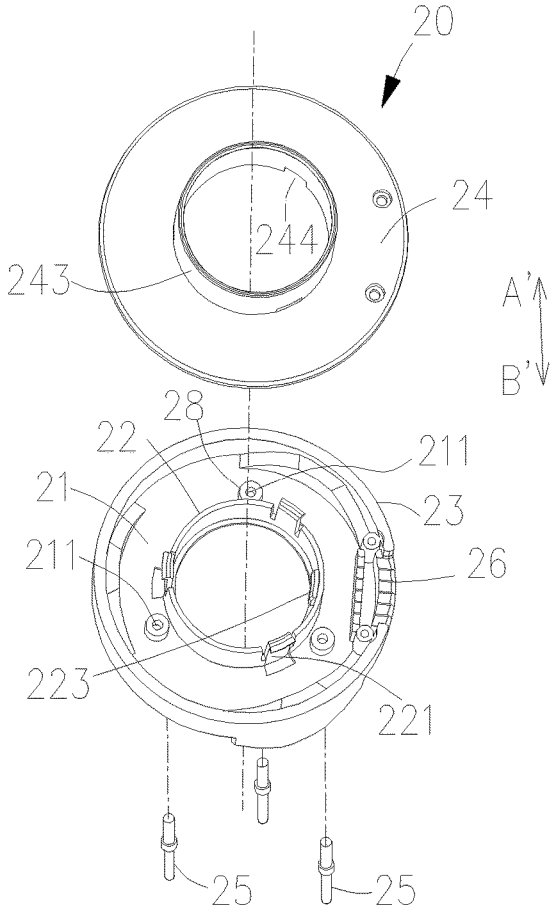
FIG. 3 is an exploded view of the second socket in FIG. 1.
Figure 7:
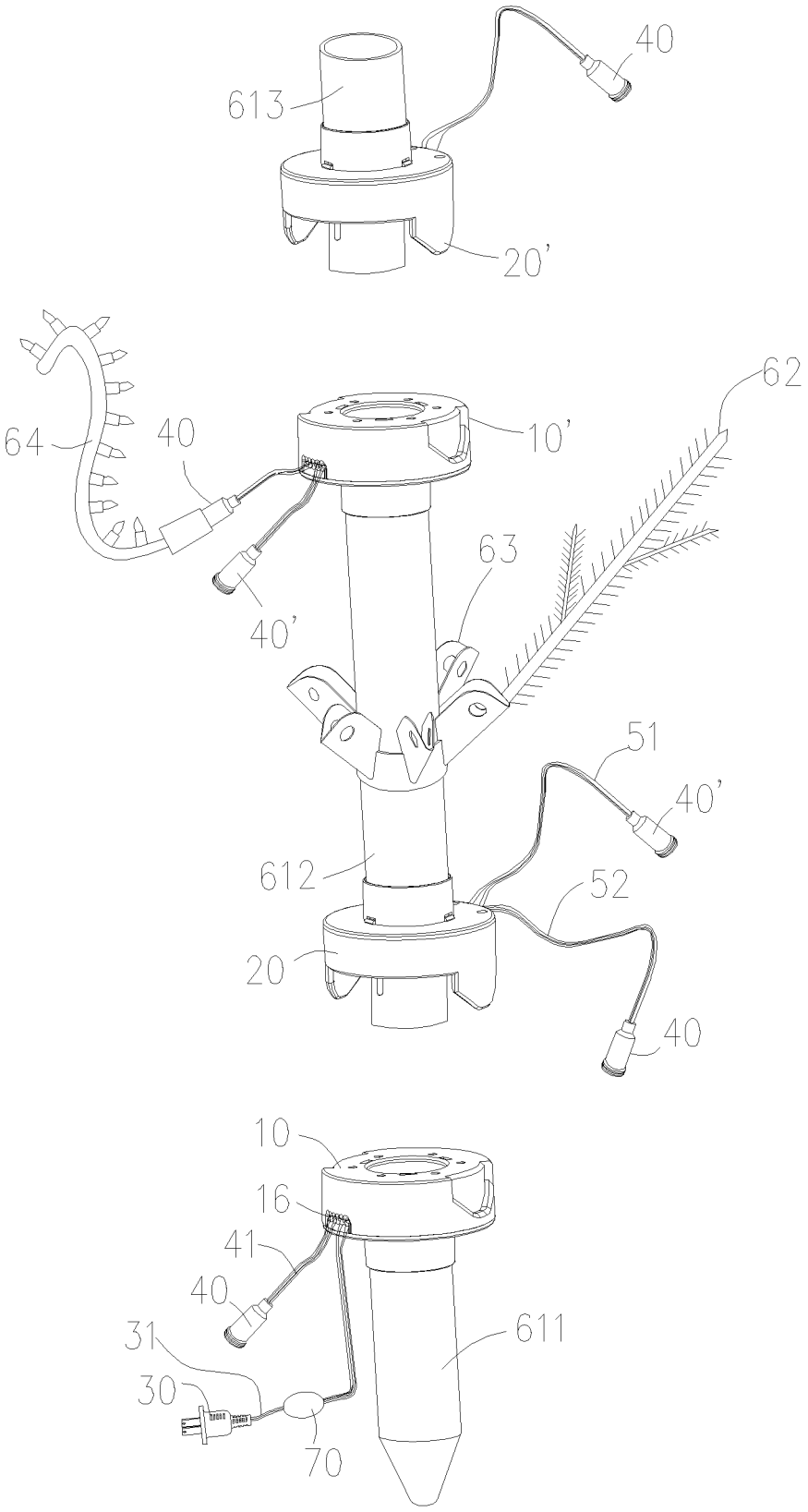
FIG. 7 is perspective view of an artificial tree having two combined power supplies fixed on the trunks in accordance with one embodiment of the present invention.

Please refer to FIGS. 1, 2 and 7, a combined power socket in accordance with an embodiment of the present invention includes a first socket 10 and a second socket 20 that are matched with each other. The first socket 10 and the second socket 20 are both designed to be sleeved on a rod or a tube, thus having a ring structure. When an end of a tube is inserted to an end of another tube, the first socket 10 which is sleeved on the end of the tube is capable of being electrically connected to the second socket 20 which is sleeved on the end of the another tube.

A first end of the first socket 10 defines six holes 111, a conductive element 15 is received in the first socket 10. A first end of the second socket 20 is formed with three conductive pins 25 that can be inserted into the six holes 111 and electrically contacts with the conductive element 15. The first socket 10 and the second socket 20 both define an outlet hole 16, 26 communicating with the inside of the sockets in their outer side walls or in a part near the outer side walls. Both the first socket 10 and the second socket 20 can lead out one group or two groups or more than two groups of conductive wires through their outlet holes as needed, and one group of conductive wires can be connected to an electrical connector 40 capable of being electrical connecting with another electrical connector of another socket or light string. Another set of conductive wires can be connected to a power plug or a power adapter for adapting to an external power socket. Another set of conductive wires can be connected to another electrical connector 40. In particular, when the conductive wires of the first socket or the second socket are connected to the power plug or a power adapter, a controller 70 is connected in series between the two. The controller 70 includes a control circuit used for outputting a control signal to one of the three conductive pins 25. The other two of the conductive pins 25 are used to connect positive and negative poles of the power supply.

Figure 4:
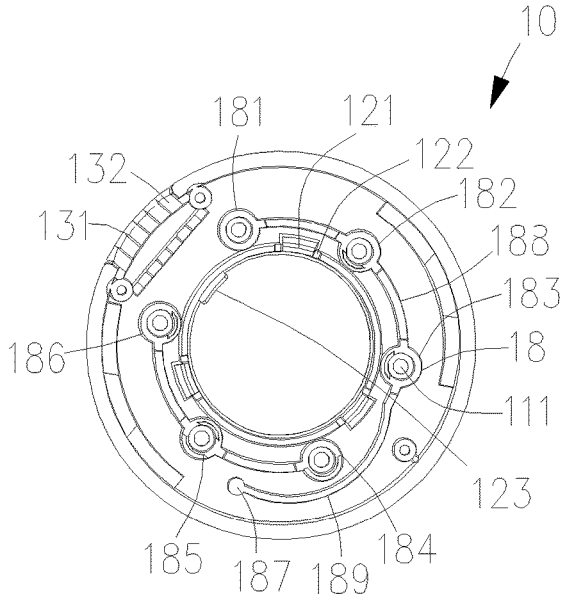
FIG. 4 is a partial view of the first socket in FIG. 1.
Figure 5:
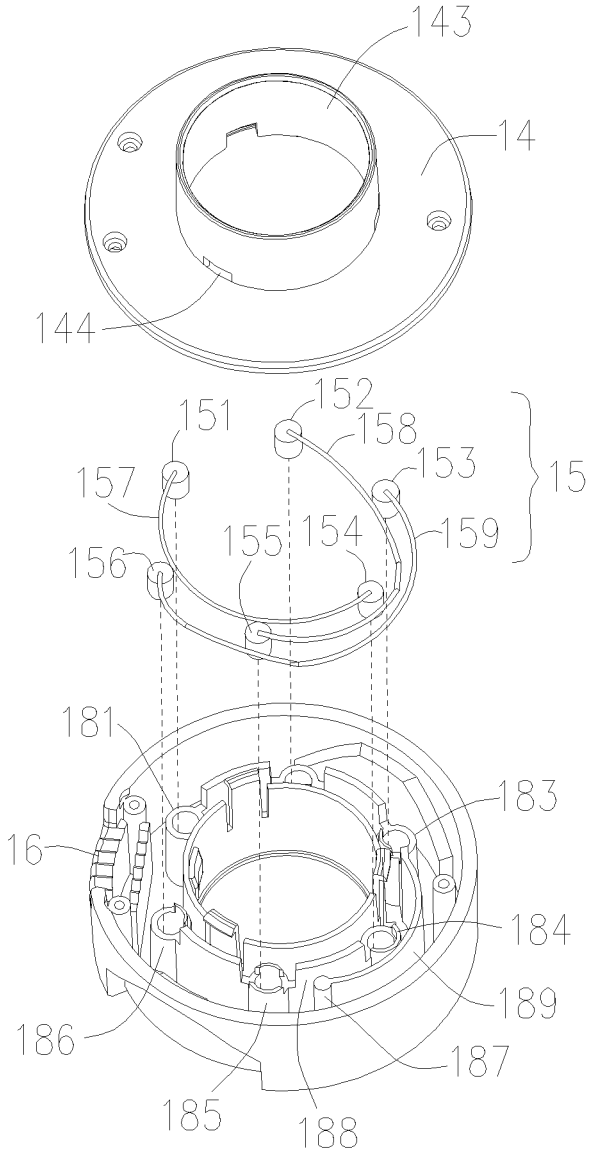
FIG. 5 is an exploded view of the first socket in FIG. 1.

Please refer to FIGS. 2, 4, and 5 at the same time. In this embodiment, the first socket 10 mainly includes a housing made of insulating material and the conductive element 15 located in the housing. The housing mainly includes an annular base plate 11, an annular (ring-shaped) inner wall 12, an annular (ring-shaped) outer wall 13 and an annular cover plate 14. The annular inner wall 12 extends substantially perpendicular from an inner edge of the base plate 11 towards a first side of the base plate (in the direction indicated by arrow A in the FIG. 2, a surface of the base plate on a second side is used as the first end of the first socket). The annular outer wall 13 extends substantially perpendicular from an outer edge of the base plate 11 towards the first side of the base plate. The annular cover plate 14 connected to ends of the inner wall 12 and the outer wall 13. The base plate 11, the cover plate 14, the inner wall 12 and the outer wall 13 define a receiving space for receiving ends of the conductive wires and the conductive element 15. In addition, the outlet hole 16 communicating the inside and outside of the first socket is formed between the end of the outer wall 13 and the edge of the cover plate 14.

The first socket 10 also includes seven pillars extending from the base plate 11 towards the first side of the base plate. Six of the seven pillars are hollow pillars with holes penetrating both ends of the pillars, which are named as a first pillar 181 and a second pillar 182, a third pillar 183, a fourth pillar 184, a fifth pillar 185, and a sixth pillar 186. Six through holes serving as the holes 111 are defined on the base plate 11 at positions corresponding to the first pillar to the sixth pillar. The holes 111 (pillars 181-186) are rotationally symmetrically distributed. In this embodiment, they are arranged on a circle, but in other embodiments, they may not be on a circle. The seventh pillar is named as a seventh pillar 187, which extends from the base plate 11 toward the first side of the base plate, and is located between the fourth pillar 184 and the fifth pillar 185 and is closer to an outer side of the circle.

Four partitions (isolation panels) 188 are formed respectively between the first pillar 181 and the second pillar 182, between the second pillar 182 and the third pillar 183, between the fourth pillar 184 and the fifth pillar 185, and between the fifth pillar 185 and the sixth pillar 186. The four partitions 188 extend substantially along the circle where the six pillars 181 to 186 are located. A partition 189 is also formed between the third pillar 183 and the seventh pillar 187 to isolate the fourth pillar 184 and the outer wall 13, therefore a space between the fourth pillar 184 and the outer wall 13 is separated into two parts. In this embodiment, the two ends of the partitions 188 and 189 are respectively connected to the pillars at both ends. In other embodiments, the partitions may not be connected to the pillars at both ends.

The conductive element 15 includes a first conductive tube 151, a second conductive tube 152, a third conductive tube 153, a fourth conductive tube 154, a fifth conductive tube 155 and a sixth conductive tube 156 respectively inserted into the first to sixth pillars 181 to 186. The first conductive tube 151 and the fourth conductive tube 154 are connected by a first conductive body 157, the second conductive tube 152 and the fifth conductive tube 155 are connected by a second conductive body 158, and the third conductive tube 153 and the sixth conductive tube 156 are connected by a third conductive body 159. The first conductive body 157, the second conductive body 158, and the third conductive body 159 are insulated and isolated by the partitions 188 and 189. Specifically, the first conductive body 157 is located in a channel defined by the annular inner wall 12, the sixth pillar 186, the fifth pillar 185 and the partition 188 between the sixth and the fifth pillars 186,185, and the fifth pillar 185, the fourth pillar 184, and the partition 188 between the fifth pillar 185 and the fourth pillar 184. A part of the second conductive body 158 is located in a channel defined by the inner wall 12 and the second pillar 182, the third pillar 183 and the partition 188 between the second pillar 182 and the third pillar 183, and a further part of the second conductive body 158 is located in a channel defined by the inner wall 12, the third pillar 183, and a part of the partition 189. The last part of the second conductive body 158 is located in a channel defined by the fourth pillar 184, the fifth pillar 185, the partition 188 between the fourth pillar 184 and the fifth pillar 185, and a part of the partition 189. A part of the third conductive body 159 is located in a channel defined by the annular outer wall 13 and the partition 189, and the other part is located in a channel defined by the annular outer wall 13, the fifth pillar 185, the sixth pillar 186 and the partition 188 between the fifth pillar 185 and the sixth pillar 186.

Figure 6:
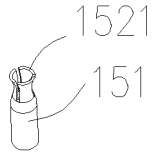
FIG. 6 is a perspective view of a conductive tube in accordance with one embodiment of the present invention.

The structures of the six conductive tubes are similar, and the structures of the three conductive bodies are similar. In the following, only the first conductive body 157 and the first conductive tube 151 are used as examples to describe the structures of the conductive bodies and the conductive tube in detail. In this embodiment, the first conductive body 151 is a metal wire or a long metal sheet, which is generally bent into an arc shape. Please refer to FIG. 6, the first conductive tube 151 is a round tube formed by bending a rectangular metal sheet, the first conductive tube 151 is connected to one end of the first conductive body 157. The end of the first conductive tube 151 away from the first conductive body 157 defines a plurality of slits (notches) extending along the axial direction thereof, so that the end of the first conductive tube 151 forms a plurality of elastic claws 1521 to facilitate the insertion of the corresponding rod-shaped pins for electrical connection. The first conductive tube 152 to the sixth conductive tube 156 are inserted into different insertion holes 111 from the first side of the base plate 11 respectively. The elastic claws of the first conductive tube 152 to the sixth conductive tube 156 do not protrude outside the insertion holes 111 to prevent accidental electric shock after the first socket 10 is powered on. In particular, since the first to third conductive bodies are all connected to the end of the corresponding conductive tube, when the conductive tubes are inserted into the insertion holes 111 of the pillars, the first, second and third conductive bodies are all higher than the pillar relative to the base plate. Therefore, the height of the partitions 188 and 189 relative to the base plate 11 should be higher than the height of the pillars relative to the base plate to prevent adjacent conductive bodies from contacting.

In addition, a tube 143 is also extending outwardly (relative to the inside of the first socket) and perpendicularly from an inner ring edge of the cover plate 14. The tube 143 is used for increasing a contact area between the first socket and the rod or tube which the first socket is sleeved on, and increasing the strength of the first socket at the same time.

In an implementation environment, as shown in FIG. 7, two power cords output by a power plug 30 or a power adapter are connected to a controller 70, and the output terminal of the controller 70 leads out three wires for outputting control signals and positive and negative power supplies. The three wires enter the accommodating cavity of the first socket 10 from the outlet hole 16 and are electrically connected to the first conductive body 157, the second conductive body 158, and the third conductive body 159, respectively. In addition, the first conductive body 157, the second conductive body 158 and the third conductive body 159 can respectively lead one or more wires to be combined into one or more bundles of wires 41, which extend from the outlet hole 16 to connect with electrical connectors 40 each having three conductive interfaces. The electrical connector 40 is adapted to an external electrical device, such as an electrical connector of a light string of a Christmas tree or an electrical connector on the second socket 20.

Please refer to FIG. 1 to FIG. 3 and FIG. 7 at the same time, the second socket 20 mainly includes a shell made of insulating material and three conductive pins 25. The shell mainly includes a ring-shaped second base plate 21, an annular (ring-shaped) second inner wall 22, an annular (ring-shaped) second outer wall 23 and an annular second cover plate 24. The annular second inner wall 22 extends substantially perpendicular from an inner edge of the second base plate 21 towards a first side of the second base plate (in the direction indicated by arrow A' in the FIG. 3, a surface of the second base plate on a second side is used as the first end of the second socket). The annular second outer wall 23 extends substantially perpendicular from an outer edge of the second base plate 21 towards the first side of the second base plate. The ring-shaped second cover plate 24 connected to the ends of the second inner wall 22 and the second outer wall 23. The second base plate 21, the second cover plate 24, the second inner wall 22 and the second outer wall 23 enclose a receiving space for receiving ends of the conductive wires and a part of the conductive pins 25. In addition, similar to the first socket 10, the outer circumference of the second base plate 21 is circular, and the outer circumference of the second cover plate 24 is circular, and the inner circumference corresponds to the shape of the second base plate 21, which can seal a space defined by the second inner wall 22 and the second base plate. A wire hole 26 is formed between the end of the second outer wall 23 and the edge of the second cover plate 24.

The second socket 20 also includes two insert pieces 27 extending from the second outer wall 23 towards a second side (in the direction indicated by the arrow B' in the FIG. 3) of the second base plate 21 opposite to the first side, and three second pillars 28 extending from the second base plate 21 towards the first side of the second base plate. Three through holes 211 penetrating both ends of the second base plate 21 and the second pillars 28 are formed on the second base plate 21 at positions corresponding to the three second pillars 28. Three conductive pins 25 are inserted into the three through holes 211 respectively and is respectively electrically connected to the three wires of the two sets of conductive wires 51 and 52 that enter the receiving cavity of the second socket 20 from the second outlet hole 26. The other ends of the conductive wires 51 and 52 located outside the second socket 20 are electrically connected to the electrical connector 40'. It can be understood that the electrical connectors connected to the ends of the conductive wires 51 and 52 may be the same or different according to actual usage conditions. Thereby, the second socket 20 can be electrically connected with the expansion first socket 10' or the second socket 20'.

In this embodiment, the two insert pieces 27 are distributed rotationally symmetrically with respect to the central axis of the second socket 20, and a part of the insert piece 27 that crosses the base plate 21 is generally triangular, and the end is arc-shaped. Correspondingly, the first socket 10 is formed with two receiving slots or avoiding space 171 for accommodating the insert pieces 27, as limiting members between the first socket and the second socket, allowing the first socket and the second socket to be plugged into each other in a first relative position or a second relative position. In this embodiment, the two insert pieces 27 are arranged at 180 degrees relative to the central axis, so that the first relative position and the second relative position are set opposite.

In addition, a tube 243 is also extending outwardly (relative to the inside of the second socket) and perpendicularly from an inner ring edge of the second cover plate 24. The tube 243 is used for increasing a contact area between the second socket and the rod or tube which the second socket is sleeved on, and increasing the strength of the second socket at the same time. Moreover, a middle of the conductive pin 25 is wider, and one end is inserted into the through hole 211 from the outside of the second base plate 21, so that a part is exposed outside the second socket 20, but does not exceed the end of the insert pieces 27, and a part extends through the second pillars 28 and is fixed and electrically connected with the conductive wires.

In order to facilitate the connection of the first socket 10 and the second socket 20, a plurality of fasteners 121 extend from the inner wall 11 of the first socket 10 towards the cover plate 14, and the ends of the fasteners 121 can be buckled on the inner edge of the cover plate 14 so that the two are fixedly connected. Correspondingly, escape positions 144 are formed on the tube 143 of the cover plate 14 corresponding to the ends of the buckles 121. Similarly, the second socket 20 is also formed with fasteners 221 similar to the fasteners 121 and escape positions 244 similar to the escape positions 144.

In addition, the inner walls oft the first socket 10 and the second socket 20 are also formed with protrusions 123 and 223 protruding toward the inner side of the inner walls. Correspondingly, openings must be formed on the rod or tube to be installed, and the first and second sockets can be stably fixed on the rod or tube, and it is not easy to slide up and down.

When in use, the first socket 10 and the second socket 20 are plugged together: the insert pieces 27 are inserted into the corresponding escape positions 171, the conductive pins 25 are inserted into the insertion holes 111 and inserted into the claw-shaped ends of the corresponding conductive tubes. For electrical connection, the first socket 10 and the second socket 20 are tightly connected together by friction between the insert pieces and the avoiding positions, the conductive pins and the conductive tubes. At this time, the power input of the combination socket only relies on, for example, the electrical connector 40 shown in FIG. 7 to supply power to the outside. If it is necessary to expand the number of electrical connectors 40, it is sufficient to increase the conductive wires drawn from the outlet holes and connect the electrical connectors, or the electrical connector 40' can be used to connect a first extension socket 10' (with the same structure of the first socket 10), and the expansion second socket 20' (with the same structure of the second socket 20) can be further expanded.

In other embodiments, another group or groups of conductive wires with one end connected to an electrical connector 40 can also enter the receiving cavity of the second socket 20 from the outlet hole 26 to be electrically connected to the three conductive pins 25 respectively. Therefore, both the first socket 10 and the second socket 20 have electrical connectors 40. It is understandable that two or more electrical connectors 40 can be drawn from the first socket 10 and/or the second socket 20 as required.

The combined power socket of the present invention has three conductive pins which are respectively connected to the positive and negative poles of a power supply and the control signal output end of the control circuit, which can realize the intelligent control of light strings. In addition, the second socket can be guided by a stopper formed by the insert pieces and the avoiding positions, and can be inserted into the first socket in two directions without considering the positive and negative poles of the power supply. The product assembly is simpler and more convenient.

In other embodiments, the insertion holes 111 may not be arranged on a circle, as long as the six insertion holes are divided into two groups, and the two sets of insertion holes are arranged rotationally symmetrically.

In other embodiments, only the electrical connector 40 may be led out from the second socket 20, and only the power plug 30 or a plug for connecting with a power adapter is provided on the first socket.

In other embodiments, the insert piece can be arranged on the first socket and the avoiding positions is arranged on the second socket.

In other embodiments, the position of the outlet hole may be set on the outer sidewalls of the first socket and the second socket, such as the outer wall 13 and the second outer wall 23. The outlet holes can also be provided on the cover plate 14 and the second cover plate 24. The number of outlet holes of each socket can be set to two or more as required.

In the above embodiment, the insert pieces extend from the outer wall of the ring structure. It is understandable that the insert pieces may also extend from the inner wall of the ring structure, or the combined power socket may have inner side insert pieces and outer side insert pieces.

It is understandable that in other embodiments, only fixing parts such as screws can be used to fix the two parts of the housing of the first socket and the second socket, so that the fasteners 121 and 221 can be omitted, as long as gaps communicating with the inside of the socket for draining liquid is formed on the inner wall 11 and the second inner wall 21, and a water inlet and a water outlet are formed at positions corresponding to the gaps on both ends of the first socket and the second socket.

FIG. 7 is a schematic diagram showing the structure of the combined power socket of the present invention when it is applied to an artificial tree. The artificial tree 60 includes a three-segment trunk (a lower trunk 611, a middle trunk 612, and an upper trunk 613), brackets 63 sleeved on the trunk for connecting the branches 62, and light strings 64 hanging on the branches 62. The first socket 10 is sleeved on an upper end of the lower trunk 611; the second socket 20 is sleeved on an lower end of the middle trunk 612, and a first socket 10' for expansion is sleeved on an upper end of the middle trunk 612; another second socket 20' is sleeved on a lower end of the upper trunk 613. When the three tree trunks 611, 612 613 are plugged together, the ends of the tree trunks are plugged together, the first socket 10 and the second socket 20 are mechanically and electrically connected, and the first socket 10' and the second socket 20' for expansion are mechanically and electrically connected. The second socket 20 and the first extension socket 10' are electrically connected through the electrical connector 40', and the current from the power plug 30 can be transmitted to the second socket 20'. The light string 64 may also be electrically connected to the electrical connectors 40 of the first socket 10' and the second socket 20'. Since all conductive wires extend from the outside of the trunk, the connection is convenient and quick. Flexible wires can be used to lead out the electrical connectors, making the connection of the light strings more convenient and quicker, and the manufacturing process of the first socket and the second socket is greatly simplified. Since the insert holes and the conductive tubes on the first socket are rotationally symmetrically distributed, the first socket and the second socket have multiple insertion directions, which is more convenient for the connection and fixation of each section of the trunk.

In the above embodiment, the first socket is used as a female plug and is fixed to the upper end of the lower tree trunk, which can prevent electric shock accidents after being powered on. The second socket is used as a male plug, and only the upper and lower tree trunks are fixedly connected and the male and female plugs are plugged into each other before being charged, and there is no danger of exposed conductive pins.

While the invention has been described in terms of several exemplary embodiments, those skilled on the art will recognize that the invention can be practiced with modification within the spirit and scope of the appended claims. In addition, it is noted that, the Applicant's intent is to encompass equivalents of all claim elements, even if amended later during prosecution.

What is claimed is:

1. A combined power socket for artificial trees, comprising:

a first socket and a second socket, wherein each of the first socket and the second socket comprises an annular structure capable of being sleeved on an outer surface and in physical contact with the outer surface of a rod or tube;

six holes being defined in a first end of the first socket or the second socket, with conductive contacts being arranged within the six holes;

three conductive pins formed on a first end of the other one of first socket and the second socket and configured to be received in the plurality of holes; and a plurality of conductive wires in electrical connection with either the conductive contacts or the conductive pins, the conductive wires extending from outer sidewalls of either the first socket or the second socket;

wherein the first socket and the second socket are provided with a plurality of position-limiting members, which can restrict the first socket and the second socket to be detachably connected together in a first relative position and a second relative position;

wherein the three conductive pins are inserted into three of the six holes when the first socket and the second socket are connected in the first relative position, the three conductive pins are inserted into the other three of the six holes when the first socket and the second socket are connected in the second relative position, so that the three conductive pins can be electrically connected with three conductive wires;

wherein two of the three conductive wires are configured to connect a positive and a negative electrodes of an external power source, and the other one is configured to connect a control circuit and receive control signals from the control circuit.

2. The combined power socket according to claim 1, wherein the holes are distributed on a circle.

3. The combined power socket according to claim 1, wherein the first socket comprises:

an annular base plate;

an annular inner wall and an annular outer wall extending perpendicularly from an inner circumference and an outer circumference of the base plate, respectively, from a first side of the base plate;

a first to a sixth pillars extending perpendicularly from the first side of the base plate, the six holes penetrating the base plate and both ends of the pillars;

a seventh pillar extending perpendicularly from the first side of the base plate, located between the fourth pillar and the fifth pillar but closer to the outer wall than the fourth pillar and the fifth pillar; and five partitions formed respectively between the first pillar and the second pillar, between the second pillar and the third pillar, between the fourth pillar and the fifth pillar, between the fifth pillar and the sixth pillar, and between the third pillar and the seventh pillar;

wherein the partition between the third pillar and the seventh pillar is configured for isolating the fourth pillar and the outer wall.

4. The combined power socket according to claim 3, wherein the conductive contacts comprise a first conductive body, a second conductive body, a third conductive body, and six conductive tubes: a first conductive tube to a sixth conductive tube; the six conductive tubes are metal tubes in a size matching an inner diameter of the six holes; the first conductive tube and the fourth conductive tube are electrically connected by the first conductive body, the second conductive tube and the fifth conductive tube are connected by the second conductive body, and the third conductive tube and the sixth conductive tube are connected by the third conductive body; the first conductive body, the second conductive body and the third conductive body are electrically insulated and isolated by the five partitions.

5. The combined power socket according to claim 4, wherein a height of the partition relative to the base plate is higher than a height of the pillars relative to the base plate.

6. The combined power socket according to claim 5, wherein the second socket comprises two insert pieces extending from the second socket toward the first socket, receiving slots or avoiding positions configured for accommodating and limiting the insert pieces are formed on the first socket.

7. An artificial tree, comprising:

at least two trunks; and a combined power socket of claim 1, sleeved on two of the at least two trunks;

wherein the first socket is sleeved on a lower one of the two trunks, the second socket is sleeved on an upper one of the two trunks, and the first socket and the second socket are electrically connected when the two trunks are connected together.

* * * * *